US010329844B2

(12) United States Patent
Wang et al.

(10) Patent No.: US 10,329,844 B2
(45) Date of Patent: Jun. 25, 2019

(54) ANCHOR ROD MULTI-SECTION REAMING MACHINE TOOL AND APPLICATION THEREOF

(71) Applicants: Chunlong Wang, Beijing (CN); Chunhu Wang, Beijing (CN)

(72) Inventors: Chunlong Wang, Beijing (CN); Chunhu Wang, Beijing (CN)

(73) Assignee: HONGYUAN ZHONGKE FOUNDATION ENGINEERING (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/521,841

(22) PCT Filed: Dec. 3, 2015

(86) PCT No.: PCT/CN2015/096252
§ 371 (c)(1),
(2) Date: Apr. 25, 2017

(87) PCT Pub. No.: WO2016/173255
PCT Pub. Date: Nov. 3, 2016

(65) Prior Publication Data

US 2017/0247950 A1 Aug. 31, 2017

(30) Foreign Application Priority Data

Apr. 29, 2015 (CN) ..... 2015 1 0210136

(51) Int. Cl.
*E21B 10/32* (2006.01)
*E21B 7/28* (2006.01)
*E21B 10/26* (2006.01)

(52) U.S. Cl.
CPC ..... *E21B 10/322* (2013.01); *E21B 7/28* (2013.01); *E21B 10/26* (2013.01)

(58) Field of Classification Search
CPC ..... E21B 10/26; E21B 10/322; E21B 7/28; E02D 5/44

(Continued)

(56) References Cited

U.S. PATENT DOCUMENTS 6,217,260 B1 * 4/2001 He ..... E02D 5/54 175/267
6,378,632 B1 4/2002 Dewey et al.
2012/0211281 A1 * 8/2012 King ..... B28D 1/14 175/57

OTHER PUBLICATIONS

Translation of CN-2635891-Y in the Information Disclosure Statement filed Apr. 25, 2017.*

(Continued)

*Primary Examiner* — David J Bagnell
*Assistant Examiner* — Yanick A Akaragwe
(74) *Attorney, Agent, or Firm* — Fay Sharpe LLP

(57) ABSTRACT

An anchor rod multi-section reaming machine tool and an application thereof are provided. The machine tool is used cooperatively with an anchor rod drill rig. A hydraulic cylinder is fixed at a lower end of a drill rod of the anchor rod drill rig. A lower end of the piston rod is fixed at an upper portion of an arch pressing device fixing disc. An arch pressing device comprises a pair of upper arch arms and a pair of lower arch arms, upper ends of the upper arch arms are rotatably connected with a central position of a lower portion of the arch pressing device fixing disc, lower ends of the upper arch arms are rotatably connected with upper ends of the lower arch arms, and lower ends of the lower arch arms are rotatably connected with a central position of an upper portion of a base plate.

9 Claims, 1 Drawing Sheet

(58) Field of Classification Search
USPC ..... 405/237, 238; 175/263, 267
See application file for complete search history.

(56) References Cited

OTHER PUBLICATIONS

International Search Report dated Mar. 10, 2016 from priority application PCT/CN2015/096252.

* cited by examiner

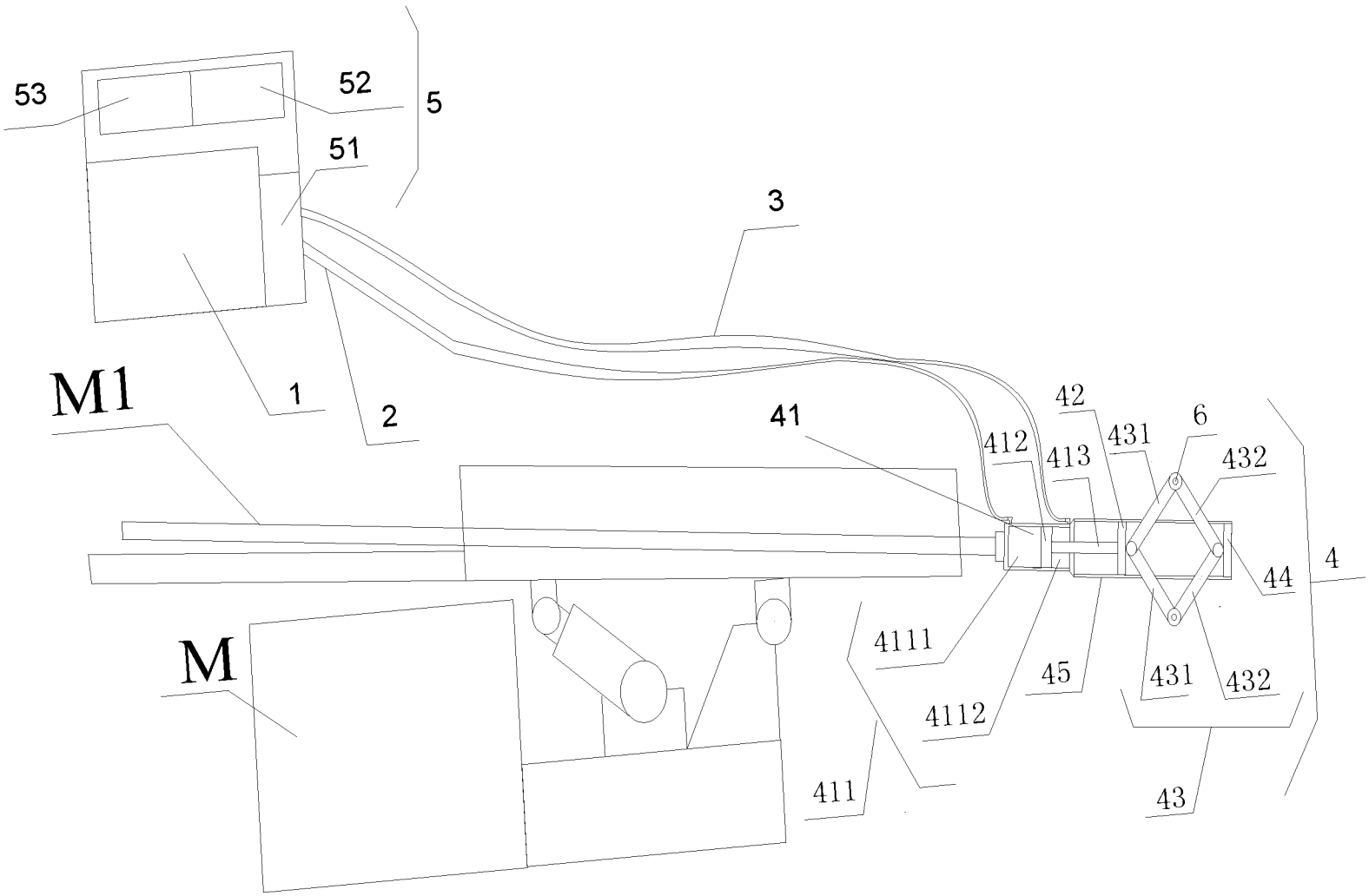
4
44
432
432
6
431
431
43
42
413
45
412
4112
4111
411
41
3
5
52
51
2
1
53
M1
M

ANCHOR ROD MULTI-SECTION REAMING MACHINE TOOL AND APPLICATION THEREOF

The present application is a 371 of PCT Application Serial No. PCT/CN2015/096252 filed Dec. 3, 2015, which claims the priority of Chinese Invention Patent Application No. 201510210136.X entitled "Anchor Rod Multi-section Reaming Machine Tool and Application Thereof" filed to the Chinese Patent Office on Apr. 29, 2015, which is incorporated herein by reference in its entirety.

FIELD OF THE INVENTION

The invention relates to the field of engineering construction equipment, and particularly to an anchor rod multi-section reaming machine tool and an application thereof.

BACKGROUND OF THE INVENTION

In foundation engineering and protective engineering for geological hazards, the anchor rod under-reaming technology is generally employed to support and reinforce the soil mass. During anchor rod reaming construction, the selection of an anchor rod reaming machine tool has an important influence on construction quality and cost.

For example, an anchor rod reaming machine tool provided by the prior art generally comprises a pressure rod, gears and reaming blades which are connected with a drill rod of an anchor rod drill rig. During use, firstly, drilling is performed by the drill rod of the anchor rod drill rig, and then the drill rod of the anchor rod drill rig is pressurized at the bottom of a hole to drive gear racks on the pressure rod for rectilinear movement, such that the gears rotate and hence the reaming blades expand or retract at the bottom of the hole to cut hole wall, thereby performing a reaming operation.

The inventors have found that the prior art at least has the following problem:

The anchor rod reaming machine tool provided by the prior art only can perform reaming at the bottom of the hole by means of blade cutting, which provides a poorer anti-pull-out property.

SUMMARY OF THE INVENTION

A technical problem to be solved by the embodiments of the invention is to provide an anchor rod multi-section reaming machine tool with high anti-pull-out property and an application thereof. A specific technical solution is as follows:

in one aspect, an embodiment of the invention provides an anchor rod multi-section reaming machine tool which is used cooperatively with an anchor rod drill rig and comprises a hydraulic station, a first pipe, a second pipe and a reaming machine head, wherein the reaming machine head comprises a hydraulic cylinder, an arch pressing device fixing disc, an arch pressing device, a base plate and a supporting structure;

the hydraulic cylinder is fixed at a lower end of a drill rod of the anchor rod drill rig;

the hydraulic cylinder comprises a cylinder body, a piston and a piston rod, the piston is arranged inside the cylinder body and can axially move relative to the cylinder body such that the cylinder body is divided into a hydraulic cylinder upper chamber and a hydraulic cylinder lower chamber which have variable volume, the hydraulic cylinder upper chamber is connected with the hydraulic station through the first pipe, the hydraulic cylinder lower chamber is connected with the hydraulic station through the second pipe, an upper end of the piston rod is fixed at a lower portion of the piston, and a lower end of the piston rod is fixed at an upper portion of the arch pressing device fixing disc;

the arch pressing device comprises a pair of upper arch arms and a pair of lower arch arms radially arranged symmetrically to the pair of upper arch arms, upper ends of the pair of upper arch arms are rotatably connected with a central position of a lower portion of the arch pressing device fixing disc, lower ends of the pair of upper arch arms are rotatably connected with upper ends of the pair of lower arch arms, and lower ends of the pair of lower arch arms are rotatably connected with a central position of an upper portion of the base plate; and the supporting structure is fixed between a lower portion of the cylinder body of the hydraulic cylinder and the base plate.

Specifically, preferably, the supporting structure is a sleeve, both ends of which are respectively sleeved and fixed at a lower end of the cylinder body of the hydraulic cylinder and on the base plate;

the arch pressing device fixing disc contacts an inner wall of the sleeve and can axially move along the inner wall of the sleeve; and side portions relative to each other of the sleeve are provided with gaps for accommodating the arch pressing device such that the arch pressing device radially expands or retracts.

Specifically, preferably, the machine tool further comprises a monitoring device which is respectively connected with the first pipe and the second pipe to monitor and display a reaming state of the machine tool.

Specifically, the monitoring device comprises a data acquisition unit, a single-chip microcomputer and a display, the data acquisition unit is connected with the first pipe and the second pipe, liquid information in the first pipe and the second pipe is acquired by the data acquisition unit, the single-chip microcomputer is connected with the data acquisition unit, the single-chip microcomputer processes the liquid information acquired by the data acquisition unit, the display is connected with the single-chip microcomputer, and a reaming state of the machine tool is displayed by the display.

Specifically, the upper arch arms are rotatably connected with the arch pressing device fixing disc via pins, the upper arch arms are rotatably connected with the lower arch arms via pins, and the lower arch arms are rotatably connected with the base plate via pins.

In another aspect, an embodiment of the invention provides a method for anchor rod reaming by the above-mentioned machine tool.

Specifically, preferably, the method comprises:

step a: drilling in the stratum to a predetermined depth by an anchor rod drill rig to obtain a pile hole;

step b: disposing a reaming machine head of the machine tool at a first position in the pile hole and disposing a hydraulic station of the machine tool outside the pile hole;

step c: supplying pressure to a hydraulic cylinder of the reaming machine head by the hydraulic station such that a piston is pushed to axially move and then the piston pushes an arch pressing device fixing disc to axially move via a piston rod and allows an arch pressing device to radially expand to squeeze a hole wall at the first position in the pile hole, thereby realizing single squeezing and expansion; and step d: at the first position, rotating the reaming machine head at a preset angle for many times, and after rotating the reaming machine head each time, repeating the step c to realize multiple squeezing and expansion until a complete disc cavity is formed at the first position, thereby realizing anchor rod reaming at the first position.

Specifically, preferably, the method further comprises: after the arch pressing device expands in a radial direction, allowing the arch pressing device to retract in the radial direction, then disposing the reaming machine head at a second position in the pile hole, and sequentially repeating the step c and the step d, thereby realizing anchor rod reaming at the second position.

Specifically, preferably, the method further comprises monitoring a state of the arch pressing device by a monitoring device to visualize the anchor rod reaming process.

The technical solutions provided by the embodiments of the invention have the following beneficial effects:

the anchor rod multi-section reaming machine tool provided by the embodiment of the invention is used cooperatively with the anchor rod drill rig by fixing the hydraulic cylinder at the lower end of the drill rod of the anchor rod drill rig; the formation is drilled to a certain depth by the anchor rod drill rig to form a pile hole, the reaming machine head of the anchor rod reaming machine tool of the invention is disposed at a certain position in the pile hole, and the hydraulic station is disposed outside the pile hole; the hydraulic station is connected with the hydraulic cylinder through the first pipe and the second pipe such that the piston in the hydraulic cylinder can be pushed to axially move under the action of a force applied by the hydraulic station and then the arch pressing device is pushed to expand to squeeze a hole wall, thereby achieving the reaming effect; on the one hand, multi-site variable-section reaming can be performed at different positions in the pile hole by such reaming mode, thereby significantly improving the anti-pull-out property of the anchor rod, effectively reducing the drilling depth of the anchor rod and saving construction cost; and on the other hand, the above reaming mode not only avoids the disturbance to the soil layer, but also can compact and reinforce the soil layer at a reaming site while reducing the production of deposit, thus better facilitating improving the subsequent concrete pouring quality.

BRIEF DESCRIPTION OF THE DRAWINGS

In order to illustrate the technical solutions in the embodiments of the invention more clearly, the accompanying drawings necessary in the descriptions of the embodiments will be simply introduced below. Apparently, the accompanying drawings in the descriptions below only involve some embodiments of the invention, and one of ordinary skill in the art can also obtain other accompanying drawings without inventive work based on these accompanying drawings.

FIG. 1 is a schematic structural view of an anchor rod reaming machine tool provided by an embodiment of the invention.

Reference numerals respectively represent as follows:

M anchor rod drill rig
M1 drill rod
1 hydraulic station
2 first pipe
3 second pipe
4 reaming machine head
41 hydraulic cylinder
411 cylinder body
4111 hydraulic cylinder upper chamber
4112 hydraulic cylinder lower chamber
412 piston
413 piston rod
42 arch pressing device fixing disc
43 arch pressing device
431 upper arch arm
432 lower arch arm
44 base plate
45 supporting structure
5 monitoring device
51 data acquisition unit
52 single-chip microcomputer
53 display
6 pin

DETAILED DESCRIPTION OF THE INVENTION

Unless otherwise defined, all technical terms used in the embodiments of the invention have the same meaning as commonly understood by those skilled in the art.

Some terms for understanding the embodiments of the invention will be defined before the embodiments of the invention will be further described in detail.

The "axial direction" in the embodiments of the invention refers to an axis direction of a rotating central shaft of a drill rod of an anchor rod drill rig, and may also be construed as a rectilinear direction of a line connecting two circle centers of two end faces of the drill rod of the anchor rod drill rig. Correspondingly, the "radial direction" refers to a direction perpendicular to the "axial direction".

In order to make the objectives, technical solutions and advantages of the invention clearer, the embodiments of the invention will be further described below in detail with reference to the accompanying drawings.

In a first aspect, an embodiment of the invention provides an anchor rod multi-section reaming machine tool, as shown in FIG. 1. The anchor rod reaming machine tool is used cooperatively with an anchor rod drill rig M. The anchor rod reaming machine tool comprises a hydraulic station 1, a first pipe 2, a second pipe 3 and a reaming machine head 4, wherein the reaming machine head 4 further comprises a hydraulic cylinder 41, an arch pressing device fixing disc 42, an arch pressing device 43, a base plate 44 and a supporting structure 45.

The hydraulic cylinder 41 is fixed at a lower end of a drill rod M1 of the anchor rod drill rig M.

The hydraulic cylinder 41 comprises a cylinder body 411, a piston 412 and a piston rod 413. The piston 412 is arranged inside the cylinder body 411 and can axially move relative to the cylinder body 411 such that the cylinder body 411 is divided into a hydraulic cylinder upper chamber 4111 and a hydraulic cylinder lower chamber 4112 which have variable volume. The hydraulic cylinder upper chamber 4111 is connected with the hydraulic station 1 through the first pipe 2, the hydraulic cylinder lower chamber 4112 is connected with the hydraulic station 1 through the second pipe 3, an upper end of the piston rod 413 is fixed at a lower portion of the piston 412, and a lower end of the piston rod 413 is fixed at an upper portion of the arch pressing device fixing disc 42.

Further, the arch pressing device 43 comprises a pair of upper arch arms 431 and a pair of lower arch arms 432 radially arranged symmetrically to the pair of upper arch arms 431. Upper ends of the pair of upper arch arms 431 are rotatably connected with a central position of a lower portion of the arch pressing device fixing disc 42; lower ends of the pair of upper arch arms 431 are rotatably connected with upper ends of the pair of lower arch arms 432; and lower ends of the pair of lower arch arms 432 are rotatably connected with a central position of an upper portion of the base plate 44.

The supporting structure 45 is fixed between a lower portion of the cylinder body 411 of the hydraulic cylinder 41 and the base plate 44.

The operating principle of the anchor rod multi-section reaming machine tool provided by the embodiment of the invention is as follows:

Firstly, the anchor rod multi-section reaming machine tool provided by the embodiment of the invention is used cooperatively with the anchor rod drill rig M by fixing the hydraulic cylinder 41 at the lower end of the drill rod M1 of the anchor rod drill rig M. The stratum is drilled by the anchor rod drill rig M to form a pile hole with a certain depth, the reaming machine head 4 of the anchor rod reaming machine tool of the invention is disposed at a certain position in the pile hole, and the hydraulic station 1 is disposed outside the pile hole (e.g. on the ground).

The hydraulic cylinder 41 is divided by the piston 412 into the hydraulic cylinder upper chamber 4111 and the hydraulic cylinder lower chamber 4112 which have variable volume, the hydraulic cylinder upper chamber 4111 is connected with the hydraulic station 1 through the first pipe 2, and the hydraulic cylinder lower chamber 4112 is connected with the hydraulic station 1 through the second pipe 3. With such arrangement, the flow direction of liquid in the first pipe 2 and the second pipe 3 can be controlled by the hydraulic station 1 so as to control a pressure difference between the hydraulic cylinder upper chamber 4111 and the hydraulic cylinder lower chamber 4112, and allow the piston 412 to axially move up and down in the cylinder body 411 under the action of the pressure difference. Since the upper end of the piston rod 413 is fixed at the lower portion of the piston 412 and the lower end of the piston rod 413 is fixed at the upper portion of the arch pressing device fixing disc 42, the axial up-and-down movement by the piston 412 can drive the piston rod 413 to synchronously move up and down, and then the piston rod 413 drives the arch pressing device fixing disc 42 fixedly connected therewith to synchronously move up and down axially. Specifically, when liquid is fed to the hydraulic cylinder upper chamber 4111, and meanwhile, the liquid is returned from the hydraulic cylinder lower chamber 4112, the piston 412 axially moves downwards such that the piston rod 413 pushes the arch pressing device fixing disc 42 to axially move downwards and then the arch pressing device fixing disc 42 applies a downward force to the arch pressing device 43 arranged at its lower portion.

The arch pressing device 43 comprises a pair of upper arch arms 431 and a pair of lower arch arms 432 radially arranged symmetrically to the pair of upper arch arms 431. Upper ends of the pair of upper arch arms 431 are rotatably connected with a central position of a lower portion of the arch pressing device fixing disc 42; lower ends of the pair of upper arch arms 431 are rotatably connected with upper ends of the pair of lower arch arms 432; and lower ends of the pair of lower arch arms 432 are rotatably connected with a central position of an upper portion of the base plate 44. When the arch pressing device fixing disc 42 applies a downward force, the upper arch arms 431 rotate around their connection point with the arch pressing device fixing disc 42 (a right arm of the upper arch arms 431 rotates counterclockwise along its connection point with the arch pressing device fixing disc 42, while a left arm thereof rotates clockwise along the connection point), in contrast, the upper arch arms 431 drive the lower arch arms 432 to rotate around their connection point with the base plate 44 (a right arm of the lower arch arms 432 rotates clockwise along its connection point with the base plate 44, while a left arm thereof rotates counterclockwise along the connection point). It can be understood that, when the upper arch arms 431 and the lower arch arms 432 rotate as described above, the upper arch arms 431 and the lower arch arms 432 also rotate relative to each other so as to ensure that the center of the arch pressing device 43 axially moves downwards and the arch pressing device radially expands as a whole to squeeze a hole wall, thereby achieving the reaming effect. When the piston 412 moves to a lowermost end in the cylinder body 411, the arch pressing device 43 expands to a maximum extent, i.e. the arch pressing device 43 has a maximum squeezing and expansion distance.

However, correspondingly, when liquid is returned from the hydraulic cylinder upper chamber 4111, and meanwhile, the liquid is fed to the hydraulic cylinder lower chamber 4112, the piston 412 axially moves upwards such that the piston rod 413 pulls the arch pressing device fixing disc 42 to axially move upwards likewise and then the arch pressing device 43 receives a pulling force applied by the arch pressing device fixing disc 42, thus allowing the upper arch arms 431 and the lower arch arms 432 thereof to move oppositely as compared to the above pushing process, i.e. the center of the arch pressing device 43 axially moves upwards and the arch pressing device radially retracts as a whole, thereby finishing a complete reaming process.

After a complete reaming process is finished, the drill rod M1 of the anchor rod drill rig M is rotated such that the reaming machine head 4 of the anchor rod reaming machine tool of the invention is disposed at another position in the pile hole; and the above reaming process is repeated until a complete disc-shaped cavity is formed on the same horizontal plane, thereby completing reaming a disc cavity. Subsequently, the reaming machine head 4 of the invention is taken out of the pile hole and the above reaming process is performed in other pile holes.

In addition, those skilled in the art can understand that, the supporting structure 45 is fixed between the lower portion of the cylinder body 411 of the hydraulic cylinder 41 and the base plate 44 to fix the base plate 44, thus ensuring that the base plate 44 does not move along with the lower arch arms 432.

As can be seen from the above, in the above reaming mode of the reaming machine tool provided by the embodiment of the invention, firstly, multi-site variable-section reaming (i.e. multi-section reaming) can be performed at different positions in a pile hole to form a complete disc-shaped cavity, thereby significantly improving the anti-pull-out property of the anchor rod, effectively reducing the drilling depth of the anchor rod and saving construction cost. Secondly, the above reaming mode not only avoids the disturbance to the soil layer, but also can compact and reinforce the soil layer at a reaming site while reducing the production of deposit, thus better facilitating improving the subsequent concrete pouring quality. Thirdly, a pressure difference between the upper and lower chambers in the hydraulic cylinder 41 is controlled by the hydraulic station 1 so as to better control pressure, thus effectively avoiding the problem that the arch pressing device 43 fails to expand or retract normally. Fourthly, since concrete and reinforcing bar are disposable materials, the reaming machine tool provided by the embodiment of the invention can allow much less concrete and reinforcing bar to be buried underground, which is more environmental-friendly.

Preferably, the supporting structure 45 is a sleeve, both ends of which are respectively sleeved and fixed at a lower end of the cylinder body 411 of the hydraulic cylinder 41 and on the base plate 44; the arch pressing device fixing disc 42 contacts an inner wall of the sleeve and can axially move along the inner wall of the sleeve; and side portions relative to each other of the sleeve are provided with gaps for accommodating the arch pressing device 43 such that the arch pressing device 43 radially expands or retracts. The supporting structure 45 is arranged as a sleeve with a cylindrical structure, which can not only effectively fix the base plate 44 to avoid its movement, but also protect the hydraulic cylinder 41 from damage. The reason is that, in the reaming process, a counterforce of the soil layer received by the arch pressing device 43 is transmitted to the sleeve via the base plate 44 and the arch pressing device fixing disc 42, such that the sleeve bears the counterforce of the soil layer received by the arch pressing device 43, which avoids the hydraulic cylinder from bearing the counterforce, and further avoids a moment of force (generated by an uneven force in each direction received by the arch pressing device 43 due to non-uniformity of the soil layer) from acting on the piston rod 413, thus preventing the piston rod 413 from being bent and broken. It can be understood that, the outside diameter of the arch pressing device fixing disc 42 matches the inside diameter of the sleeve such that an annular side portion of the arch pressing device fixing disc 42 fully contacts with the inner wall of the sleeve to transfer the above counterforce to the sleeve. Further, a smooth abrasion-resistant coating (e.g. a ceramic coating, an alloy coating, etc.) can be coated on the inner wall of the sleeve to reduce the friction between the sleeve and the arch pressing device fixing disc 42.

Furthermore, in the embodiment of the invention, side portions relative to each other of the sleeve are also provided with gaps for accommodating the arch pressing device 43 such that the arch pressing device 43 radially expands or retracts. The gaps are preferably sized and constructed such that the upper arch arms 431 and the lower arch arms 432 can pass and rotate. It follows that the supporting structure 45 configured as a sleeve has a greater force bearing area and a longer service life than a rod-shaped supporting structure 45.

Further, an embodiment of the invention provides a machine tool with a more preferred structure, wherein the machine tool further comprises a monitoring device 5 which is respectively connected with the first pipe 2 and the second pipe 3 to monitor and display a reaming state of the machine tool.

Currently, a reaming device is generally located deeply underground and soaked in slurry for most of the time during construction, so a reaming state of the device cannot be monitored on the ground, the construction quality is hence completely determined by operators according to their personal experience, and construction data is manually recorded. Accordingly, the reaming quality cannot be ensured or even the reaming diameter is unqualified, thus affecting the engineering quality. In the embodiment of the invention, since the liquid feeding process is separated from the liquid return process, the liquid feeding amount and the liquid return amount of the hydraulic cylinder 41 can be determined by acquiring liquid flowing information in the first pipe 2 and the second pipe 3, thus liquid information at every moment in the first pipe 2 and the second pipe 3 can correspond to a specific reaming state. The monitoring device 5 is arranged on the ground, and configured to monitor an underground-reaming state by detecting the liquid feeding amount and the liquid return amount in the first pipe 2 and the second pipe 3 so as to ensure stable reaming quality and provide a qualified reaming diameter, thus ensuring the engineering quality.

Specifically, the monitoring device 5 comprises a data acquisition unit 51, a single-chip microcomputer 52 and a display 53, wherein the data acquisition unit 51 is connected with the first pipe 2 and the second pipe 3, liquid information in the first pipe 2 and the second pipe 3 is acquired by the data acquisition unit 51, the single-chip microcomputer 52 is connected with the data acquisition unit 51, the single-chip microcomputer 52 processes the liquid information acquired by the data acquisition unit 51, the display 53 is connected with the single-chip microcomputer 52, and a reaming state of the machine tool is displayed by the display 53.

In the embodiment, the data acquisition unit 51 is used to acquire flow rate information in the first pipe 2 and the second pipe 3 and transmit the acquired liquid information to the single-chip microcomputer 52; the single-chip microcomputer 52 processes corresponding liquid information and generates data of the reaming state of the invention; the single-chip microcomputer 52 transmits the reaming state data of a hole to the display 53; and the reaming state of the invention is displayed by the display 53. Indeed, those skilled in the art can understand that, a printer can also be connected to the single-chip microcomputer 52 so that the reaming state of the invention can be directly printed.

Specifically, the upper arch arms 431 are rotatably connected with the arch pressing device fixing disc 42 via pin 6, the upper arch arms 431 are rotatably connected with the lower arch arms 432 via pin 6, and the lower arch arms 432 are rotatably connected with the base plate 44 via pin 6.

In the embodiment of the invention, the upper arch arms 431 and the arch pressing device fixing disc 42, the lower arch arms 432 and the base plate 44, and the upper arch arms 431 and the lower arch arms 432 are connected via the pin 6, which provides a simple structure, reasonable force bearing and mounting convenience. Indeed, those skilled in the art can know that the above connection can also be achieved by other ways of connection, as long as the upper arch arms 431 can rotate relative to the arch pressing device fixing disc 42 in a plane on which their connection point with the arch pressing device fixing disc 42 and an axis of the arch pressing device fixing disc 42 are present, the lower arch arms 432 can rotate relative to the base plate 44 in a plane on which their connection point with the base plate 44 and an axis of the base plate 44 are present, and the upper arch arms 431 and the corresponding lower arch arms 432 can rotate relative to each other in a plane on which their connection points and their respective connection point with the arch pressing device fixing disc 42 or the base plate 44 are present.

In a second aspect, an embodiment of the invention further provides an application of the anchor rod multi-section reaming machine tool in anchor rod reaming, i.e. a method for anchor rod reaming by any one anchor rod multi-section reaming machine tool as described above. Specifically, the method comprises the steps of:

step 101: drilling in the stratum to a predetermined depth by an anchor rod drill rig M to obtain a pile hole;

step 102: disposing a reaming machine head 4 of the anchor rod reaming machine tool at a first position in the pile hole and disposing a hydraulic station 1 of the anchor rod reaming machine tool outside the pile hole (e.g. on the ground);

step 103: supplying pressure to a hydraulic cylinder 41 of the reaming machine head 4 by the hydraulic station 1 such that a piston 412 is pushed to axially move and then the piston 412 pushes an arch pressing device fixing disc 42 to axially move via a piston rod 413 and allows an arch pressing device 43 to radially expand to squeeze a hole wall at the first position in the pile hole, thereby realizing single reaming; and step 104: at the first position, rotating the reaming machine head 4 at a preset angle for many times, and after rotating the reaming machine head 4 each time, repeating the step 103 to realize multiple squeezing and expansion until a complete disc cavity is formed at the first position, thereby realizing anchor rod reaming at the first position.

Those skilled in the art can understand that, the first position may be any position in the pile hole according to the actual reaming demand, and therefore does not have a specific meaning herein. In addition, the above complete disc cavity formed in the construction carried out by the machine tool provided by the embodiment of the invention has an inner diameter of about 500-1000 mm, e.g. 550 mm, 600 mm, 650 mm, 700 mm, 750 mm, 800 mm, 850 mm, 900 mm, 950 mm, 1000 mm, etc.

It follows that the anchor rod multi-section reaming machine tool provided by the embodiment of the invention can perform anchor rod multi-section reaming in the soil layer and can effectively support and reinforce the soil mass.

Further, the method further comprises step 105: after the arch pressing device 43 expands in a radial direction, allowing the arch pressing device 43 to retract in the radial direction, then disposing the reaming machine head 4 at a second position in the pile hole, and repeating the step 103 and the step 104 again, thereby realizing anchor rod reaming at the second position.

It follows that, by repeating the step 105 for many times, multi-site variable-section reaming can be performed at different positions in the pile hole to form a complete disc-shaped cavity, thereby significantly improving the anti-pull-out property of the anchor rod, effectively reducing the drilling depth of the anchor rod and saving construction cost.

Specifically, preferably, in the above reaming process, a state of the arch pressing device 43 is monitored by the monitoring device 5 to visualize the anchor rod reaming process. Monitoring a reaming state of the arch pressing device 43 underground by the monitoring device 5 can ensure stable reaming quality and provide a qualified reaming diameter, thus ensuring the engineering quality.

The above description only refers to preferred embodiments of the invention and is not intended to limit the invention. Any modification, equivalent replacement, improvement and the like made within the sprit and principle of the invention shall be included within the protection scope of the invention.

The invention claimed is:

1. An anchor rod multi-section reaming machine tool used cooperatively with an anchor rod drill rig, comprising a hydraulic station, a first pipe, a second pipe and a reaming machine head, wherein the reaming machine head comprises a hydraulic cylinder, an arch pressing device fixing disc, an arch pressing device, a base plate and a supporting structure;

the hydraulic cylinder is fixed at a lower end of a drill rod of the anchor rod drill rig;

the hydraulic cylinder comprises a cylinder body, a piston and a piston rod, the piston is arranged inside the cylinder body and axially moves relative to the cylinder body such that the cylinder body is divided into a hydraulic cylinder upper chamber and a hydraulic cylinder lower chamber which have variable volume, the hydraulic cylinder upper chamber is connected with the hydraulic station through the first pipe, the hydraulic cylinder lower chamber is connected with the hydraulic station through the second pipe, an upper end of the piston rod is fixed at a lower portion of the piston, and a lower end of the piston rod is fixed at an upper portion of the arch pressing device fixing disc;

the arch pressing device comprises a pair of upper arch arms and a pair of lower arch arms radially arranged symmetrically to the pair of upper arch arms, upper ends of the pair of upper arch arms are rotatably connected with a central position of a lower portion of the arch pressing device fixing disc, lower ends of the pair of upper arch arms are rotatably connected with upper ends of the pair of lower arch arms, and lower ends of the pair of lower arch arms are rotatably connected with a central position of an upper portion of the base plate; and the supporting structure is fixed between a lower portion of the cylinder body of the hydraulic cylinder and the base plate.

2. The machine tool according to claim 1, wherein the supporting structure is a sleeve, both ends of which are respectively sleeved and fixed at a lower end of the cylinder body of the hydraulic cylinder and on the base plate;

the arch pressing device fixing disc contacts an inner wall of the sleeve and axially moves along the inner wall of the sleeve; and side portions relative to each other of the sleeve are provided with gaps for accommodating the arch pressing device such that the arch pressing device radially expands or retracts.

3. The machine tool according to claim 1, wherein the machine tool further comprising a monitoring device which is respectively connected with the first pipe and the second pipe to monitor and display a reaming state of the machine tool.

4. The machine tool according to claim 3, wherein the monitoring device comprises a data acquisition unit, a single-chip microcomputer and a display, the data acquisition unit is connected with the first pipe and the second pipe, liquid information in the first pipe and the second pipe is acquired by the data acquisition unit, the single-chip microcomputer is connected with the data acquisition unit, the single-chip microcomputer processes the liquid information acquired by the data acquisition unit, the display is connected with the single-chip microcomputer, and a reaming state of the machine tool is displayed by the display.

5. The machine tool according to claim 4, wherein the upper arch arms are rotatably connected with the arch pressing device fixing disc via pin, the upper arch arms are rotatably connected with the lower arch arms via pin, and the lower arch arms are rotatably connected with the base plate via pin.

6. An anchor rod reaming method applied by an anchor rod multi-section reaming machine tool used cooperatively with an anchor rod drill rig, wherein the machine tool comprises a hydraulic station, a first pipe, a second pipe and a reaming machine head, wherein the reaming machine head comprises a hydraulic cylinder, an arch pressing device fixing disc, an arch pressing device, a base plate and a supporting structure;

the hydraulic cylinder is fixed at a lower end of a drill rod of the anchor rod drill rig;

the hydraulic cylinder comprises a cylinder body, a piston and a piston rod, the piston is arranged inside the cylinder body and axially moves relative to the cylinder body such that the cylinder body is divided into a hydraulic cylinder upper chamber and a hydraulic cylinder lower chamber which have variable volume, the hydraulic cylinder upper chamber is connected with the hydraulic station through the first pipe, the hydraulic cylinder lower chamber is connected with the hydraulic station through the second pipe, an upper end of the piston rod is fixed at a lower portion of the piston, and a lower end of the piston rod is fixed at an upper portion of the arch pressing device fixing disc;

the arch pressing device comprises a pair of upper arch arms and a pair of lower arch arms radially arranged symmetrically to the pair of upper arch arms, upper ends of the pair of upper arch arms are rotatably connected with a central position of a lower portion of the arch pressing device fixing disc, lower ends of the pair of upper arch arms are rotatably connected with upper ends of the pair of lower arch arms, and lower ends of the pair of lower arch arms are rotatably connected with a central position of an upper portion of the base plate; and the supporting structure is fixed between a lower portion of the cylinder body of the hydraulic cylinder and the base plate;

wherein the anchor rod reaming method comprises:

step a: drilling in the stratum to a predetermined depth by the anchor rod drill rig to obtain a pile hole;

step b: disposing the reaming machine head of the machine tool at a first position in the pile hole and disposing the hydraulic station of the machine tool outside the pile hole:

step c: supplying pressure to a hydraulic cylinder of the reaming machine head by the hydraulic station such that the piston is pushed to axially move, and then the piston pushes the arch pressing device fixing disc to axially move via the piston rod and allows the arch pressing device to radially expand to squeeze a hole wall at the first position in the pile hole, thereby realizing single squeezing and expansion; and step d: at the first position, rotating the reaming machine head at a preset angle for many times, and after rotating the reaming machine head each time, repeating the step c to realize multiple squeezing and expansion until a complete disc cavity is formed at the first position, thereby realizing anchor rod reaming at the first position.

7. The method according to claim 6, further comprising: after the arch pressing device expands in a radial direction, allowing the arch pressing device to retract in the radial direction, then disposing the reaming machine head at a second position in the pile hole, and sequentially repeating the step c and the step d, thereby realizing anchor rod reaming at the second position.

8. The method according to claim 7, further comprising: monitoring a state of the arch pressing device by a monitoring device to visualize the anchor rod reaming process.

9. The method according to claim 6, further comprising: monitoring a state of the arch pressing device by a monitoring device to visualize the anchor rod reaming process.

* * * * *